United States Patent [19]

Zeley

[11] 4,022,383

[45] May 10, 1977

[54] NOZZLE FOR WELDING, HEATING, CUTTING AND/OR FLAME CLEANING

[76] Inventor: Juan A. Zeley, Avenida Principal Colinas, Apartado Postal 60061, Caracas, Venezuela

[22] Filed: Nov. 3, 1975

[21] Appl. No.: 627,922

[30] Foreign Application Priority Data

Nov. 2, 1974 Germany ..... 2452004

[52] U.S. Cl. ..... 239/419.3; 239/422; 239/424

[51] Int. Cl.[2] ..... B05B 7/00

[58] Field of Search ..... 239/419, 419.3, 422, 239/424, 424.5

[56] References Cited

UNITED STATES PATENTS

| | | | |
|---|---|---|---|
| 1,460,662 | 7/1923 | Drager et al. | 239/424 |
| 1,955,120 | 4/1934 | Fausek et al. | 239/424.5 |
| 2,192,661 | 3/1940 | Jones | 239/424 |
| 2,210,402 | 8/1940 | Gaines, Jr. | 239/422 X |
| 2,302,734 | 11/1942 | Babcock | 239/424.5 |
| 2,499,524 | 3/1950 | Pach | 239/424 |

*Primary Examiner*—John J. Love

*Attorney, Agent, or Firm*—Gifford, Chandler, Sheridan & Sprinkle

[57] ABSTRACT

The specification describes a nozzle for welding, heating, cutting and/or flame cleaning, comprising a cutting oxygen duct with an internal mixing device, arranged in the nozzle head, for heating gas and heating oxygen. There are also metering channels, possibly arranged around the centrally placed oxygen duct, for heating gas and heating oxygen. The heating oxygen metering ducts and the heating gas metering ducts open separately into a mixing chamber. From the mixing chamber an annular heating mixture duct leads to the gas outlet nozzle shank end.

8 Claims, 7 Drawing Figures

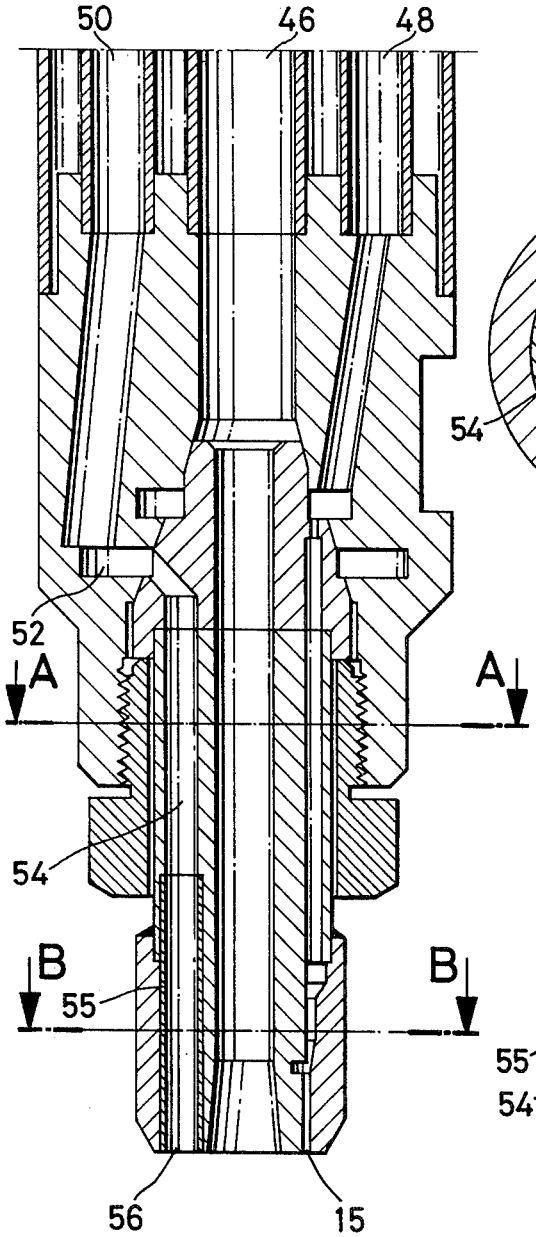
Fig.3
Fig.4
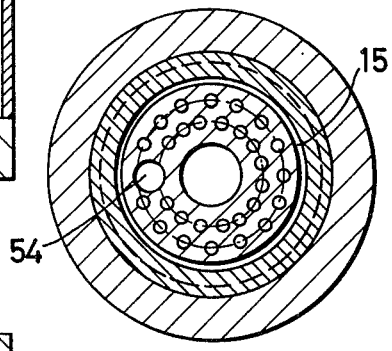
Fig.5
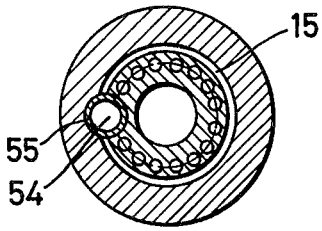

NOZZLE FOR WELDING, HEATING, CUTTING AND/OR FLAME CLEANING

BACKGROUND OF THE INVENTION

I. Field of the invention

The invention relates to a nozzle for welding, heating, cutting and/or flame cleaning, comprising a cutting oxygen duct and with an internal mixing device, arranged in the nozzle head, for heating gas and heating oxygen and with metering channels possibly arranged around the centrally placed oxygen duct, for heating gas and heating oxygen.

II. Description of the Prior Art

In the case of copper alloy nozzles in accordance with the prior art for the heating, necessary in the case of flame cutting operations, of the material to be cut and in the case of welding operations, the heating gas and the oxygen are passed unmixed before ignition into the nozzle body and are so introduced into it that they supply a hot even flame or several individual flames. As a matter of principle for the operations under discussion three different heating systems are employed:

1. The heating system with post-mixture in which the heating gas and heating oxygen are supplied in the nozzle and are only mixed after emergence from the nozzle;

2. the injector heating system in which the heating gas and the heating oxygen are mixed in or at the nozzle due to the heating gas entraining the heating oxygen or vice versa due to the injector-like construction of the nozzle; and 3. the heating system with multiple internal mixing in which due to the construction of a large number of small injector ducts with mixing zones on the nozzle cross-section a large number of small heating flames are formed.

The nozzles mentioned in paragraph (1) above when suitably constructed, prevent flashback and backfire. They are relatively insensitive to pressure changes and can also be produced economically. Their disadvantage resides in that the mixing of the two heating media is incomplete and this gives rise to a lesser heating efficiency and to a relatively high gas consumption. The nozzles mentioned in paragraph (2) above can also be economically produced. They produce a better mixing action and therefore a better heating efficiency than nozzles of the first group. They can, however, flashback and backfire and are very sensitive to changes in pressure or adjustment of pressure. As a result their construction and efficiency is limited.

The nozzles described in paragraph (3) above can be made as reliably as the nozzles of the first group. The gas oxygen utilization is optimum and the heating flames have a high temperature. However, they have the disadvantage that their production is relatively expensive because the heating flames must be projected in a concentrated manner. The construction of such ducts is very difficult to carry out. Furthermore, in the case of cutting and flame cleaning nozzles of this type the encasing of the oxygen jet is not optimum so that the impingement surface of the heating flames is excessively large. There are also difficulties with regard to setting and pressure differences in nozzles of this type.

SUMMARY OF THE PRESENT INVENTION

One aim of the invention is that of providing a nozzle of the initially mentioned type which is optimally suitable for welding heating cutting and/or flame cleaning. A further object is to provide a nozzle which is insensitive to variation in pressure and in the case of which no setting difficulties occur. Furthermore, the nozzle should be capable of being produced economically and should also operate economically.

This is achieved in accordance with the invention in that the heating oxygen metering ducts and the heating gas metering ducts open separately into a mixing chamber and in that from the mixing chamber an annular heating mixture duct leads to the gas outlet nozzle shank end.

In accordance with a further development of the invention the nozzle shank end forms pressure chambers while the lowermost mixing chambers with the outer longitudinal sides of the nozzle core on both sides of the oxygen duct form a respective heating mixture duct. For delimitation of the heating oxygen and the heating gas ducts side screens are provided which lie against the narrow sides of the nozzle screens and of the nozzle core.

In accordance with a further development of the invention in the annular duct between the pressure chamber and the mixing chamber a narrow part is formed by means of an oblique surface provided in the nozzle ring.

In accordance with another development of the invention the end of the nozzle shank is conically tapered and the nozzle ring is conically constructed within the mixing chamber so that a conical heating mixture duct is formed, which at the end of the nozzle shank merges with an outlet duct. Furthermore, the mixing chamber is constructed so as to taper towards the outlet end.

The construction of the nozzle in accordance with the invention is very simple and can therefore also be produced cheaply. The tapering section of the nozzle shank is reduced to a smaller diameter than the annular gap in the nozzle outlet. The nozzle ring constructed in a stepped manner in the interior forms a pressure chamber and a mixing chamber, which are connected by means of an annular gap. The tapering in the internal annular channel brings about a choking back of the heating gas emerging from the heating gas ducts into the mixing chamber and therefore ensures an optimum mixing and utilization of the heating media. The heating oxygen which flows out by itself through the mixing chamber and the high supply speed of the heating gas over the sharp edges of this chamber increase reliability as regards freedom from backfiring or flashback. The heating gas duct is by itself passed from the nozzle head through the nozzle shank into its mixing chamber so that the heating gas is subjected to a slight extent to pressure equalization. It then flows with a high velocity over the sharp edge into the heating oxygen so that optimum mixing is guaranteed.

The heating gas mixture emerging from the annular duct forms, after ignition, a narrow flame ring for the cutting oxygen jet and retains it well, which leads to a narrower cutting gap or cut and therefore to a saving in material. Furthermore, the narrow heating flame ring conveys more thermal energy into the cutting gap, which leads to improved removal of slag and thus to a higher cutting speed with a saving in gas.

The annular duct at the nozzle outlet is insensitive to contamination and damage. Furthermore, an improved cooling action occurs, which is due to the large-area contact between the heating gas mixture and the inner wall of the nozzle ring, which can readily be unscrewed from the nozzle shank.

An advantageous further development of the invention resides in that on the side, which is to the rear in the direction of cutting, of the nozzle the latter is provided with an additional post-combustion hole, whose outlet opening is larger than the outlet breadth of the annular heating mixture channel and through the post-combustion hole pure heating gas emerges, as far as possible in an unmixed condition.

Such a further development of the nozzle is more particularly suitable for rapid cutting, for cutting material with a considerable thickness and for smooth cutting with a simultaneous economic utilization of the gas. In this respect it is convenient to connect the post-combustion hole with the heating gas metering ducts or it is possible to provide for separate supply into the post-combustion hole for the post-combustion gas in the nozzle on the cutting blowpipe. With this arrangement it is possible to supply the post-combustion hole with post-combustion gas, via solenoid valves and is prevented from flowing in the wrong direction by the use of check valves, during burning from the normal heating gas supply or between cutting operations in quantities and pressures only for a satisfactory and reliable pilot flame.

In accordance with a further development of the invention there is the feature that a valve adjacent to the post-combustion supply allows the supply of heating oxygen into the annular heating mixture duct possibly with a reduced pressure without heating gas.

DESCRIPTION OF THE DRAWINGS

The invention will now be explained in what follows with reference to embodiments making reference to the accompanying drawings.

FIG. 3 shows a cross-section through a modified embodiment of the nozzle.

FIG. 4 shows a section along the line A—A in FIG. 3.

FIG. 5 shows a section along the line B—B in FIG. 3.

DETAILED DESCRIPTION OF THE PRESENT INVENTION

Figure 1:
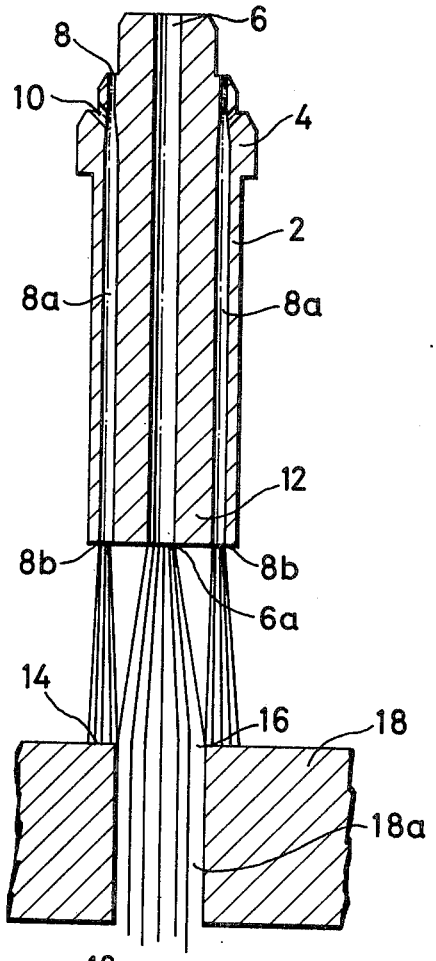
PRIOR ART Fig.1
FIG. 1 shows a longitudinal section of a prior art cutting nozzle above the material being cut.
Figure 1A:
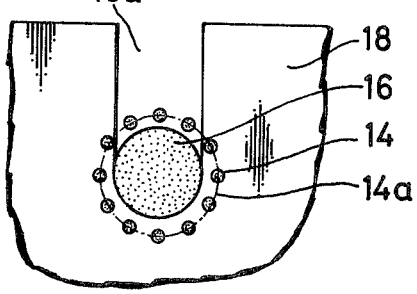
PRIOR ART Fig.1a
FIG. 1*a* shows a cross-section of a nozzle and of the material in accordance with FIG. 1.

The nozzle shown in FIG. 1 is of prior art type and comprises a nozzle shank 2 on which a nozzle head 4 is formed, in which in the middle a cutting oxygen duct 6, a heating oxygen connection 8 and a heating gas connection 10 are provided. The two latter are continued as far as the nozzle outlet 8*b* as heating oxygen and heating gas mixing ducts 8*a*. At the outlet end between the cutting oxygen duct 6 and the heating gas duct ring 14*a* (FIG. 1*a*) a nozzle core 12 is formed. In the case of this prior art nozzle construction the relatively thick cutting oxygen jet fanning out between the end 6*a* of the nozzle shank 2 and the position of impingement 16 on the material to be cut is surrounded by a wreath or ring consisting of a large number of small heating gas jets 14, which as is shown in FIG. 1, owing to their low divergence cannot bring about any homogeneous enclosure of the oxygen jet. The consequence of this is that due to a low degree of heating up of the material and considerable fanning out of the cutting oxygen jet, a broad cut is produced, something which produces material wastage and high gas consumption.

Figure 2:
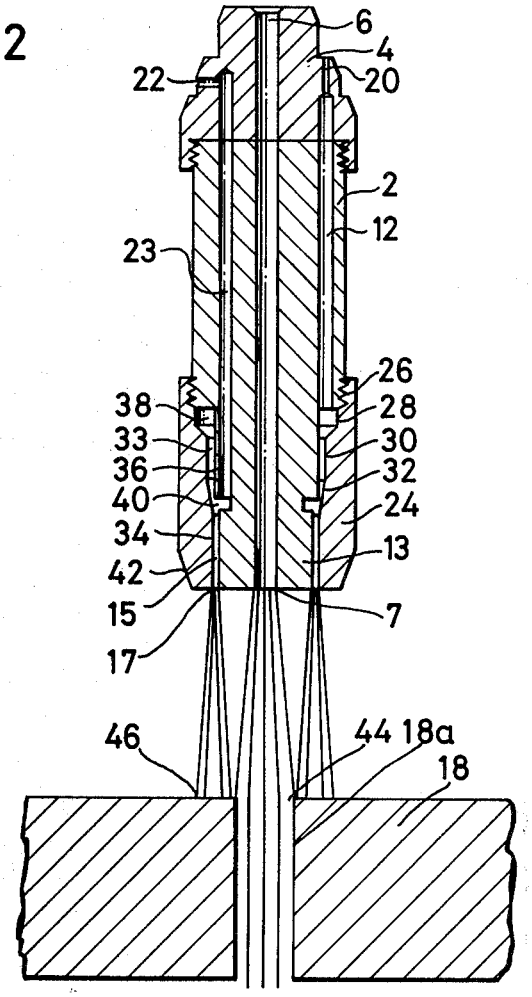
FIG. 2 shows a longitudinal section of a preferred embodiment of the nozzle in accordance with the invention above the material to be worked.

The preferred embodiment of the proposed nozzle in accordance with the invention is shown by FIG. 2 in longitudinal section. This nozzle consists of the nozzle shank 2, on which at the upper end a nozzle head 4 is screwed while at the lower end a nozzle ring 24 is screwed. Through the nozzle shank 2 and the nozzle head 4 there extend a cutting oxygen duct 6, a heating oxygen duct 12 and a heating gas duct 23 in an aligned fashion, whose connections 20 and 22 can be suitably joined to supply hoses. The cutting oxygen duct 6 extends centrally through the whole nozzle shank 2 as far as the outlet opening 7 while the heating oxygen duct 12 ends at a first reducing step in the nozzle shank 2 and the heating gas duct 23 ends at a second reducing step in the shank 2. The nozzle ring is internally provided with several steps reducing its cross-section. The largest step 26 carries a screw thread and is intended for screwing onto the non-stepped part of the nozzle shank 2. The second step 28 forms with a first step of the nozzle shank 2 an annular chamber 38, which acts as a pressure equalization chamber and by means of a conically tapered part in the nozzle ring 24 is connected with or merges into an annular duct 33 formed with the third step 30 of the ring 24. The duct 33 for its part opens via a conical surface 32, producing a restriction, into the annular mixing chamber 40, which is formed by a cut or groove into the end part of the nozzle shank 2. The heating gas duct 23 opens directly into this chamber and is screened off from the annular channel or duct 33 by means of a screen 36. Between the second step of the nozzle shank 2 and, respectively, of the nozzle core 13 and the smallest step 34 of the nozzle ring 24 the outlet annular channel 15 is formed, which can also be directed conically towards the cutting oxygen outlet opening 7.

In the case of a fishtail nozzle (not shown) on the two longitudinal sides of the nozzle core 13 stepped nozzle screens 36 can be arranged. The ducts 12 and 23 then would open into the pressure chamber 38 constructed as post-mixing chamber, while the mixing chamber 40 would form, together with the walls of the nozzle core 13, the heating gas mixing duct 15 on both sides of the cutting oxygen duct 6.

Figure 2A:
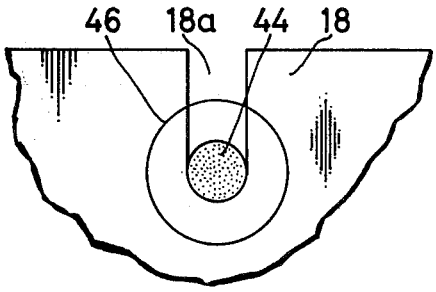
FIG. 2*a* shows a cross-section of the nozzle and of the material in accordance with FIG 2.

As is shown by FIGS. 2 and 2*a*, the jets of the heating gas mixture fan out substantially more than is the case with the nozzle shown in FIG. 1 after emergence of the gas from the annular nozzle duct 15 between the outlet ring 17 and the impingement surface 40 onto the material being handled. Accordingly also the fanning out of the cutting oxygen jet between the outlet opening 7 and the position 44 of impingement is limited. As can be seen from FIG. 2*a* as a result the heating-up ring 46 is substantially enlarged and the cutting gap or groove 18*a* is made correspondingly narrower.

In FIG. 3 a further embodiment of the nozzle is represented. In the center a cutting oxygen duct 46 is again provided which is adjacent to a heating oxygen connection 48 and a burning gas connection 50. In principle the nozzle is constructed as already described above. An additional post-combustion hole 54 extends from the heating gas chamber 52 of annular form. The hole 54 is screened by a sleeve 55 from the outlet duct 15 of annular form. In this manner combustion gas can pass to the combustion gas outlet opening unmixed without mixing. In operation the post-combustion hole is so arranged that it is located at the end of the nozzle to the rear in terms of the direction of movement. In this manner the nozzle makes possible a high cutting speed, and improved surfaces, since a soft flame is produced and it is possible to cut larger thicknesses and also slag conditions are substantially improved. The post-combustion gas arrives late, that is to say deep in the cut and comes into contact with the residual heating and cutting oxygen and only burns at this position. It is also possible for the post-combustion hole 54 to be connected with a separate supply for the post-combustion gas from the cutting blowpipe. As a result it becomes possible to supply the post-combustion duct with post-combustion gas, supplied using solenoid valves and to protect it against flow in the wrong direction by check valves, during burning from the normal heating gas supply or between burning operations with quantities and pressures suitable for a satisfactory and reliable pilot flame.

Such a post-combustion hole also makes it possible to supply heating oxygen, possibly with a reduced pressure and without heating gas, to the post-combustion gas flow.

Thus the present invention provides a nozzle shank end which is reduced as a nozzle core down to a diameter which is smaller than the annular duct formed by an metering ducts and the annular duct which opens at its inner upper end in an annular chamber formed with the nozzle core and an annular chamber which is connected via the annular duct with the outlet ring.

The present invention further provides a nozzle core which is clad by a nozzle ring, which has several internal steps, of which the largest step serves for attachment on the non-reduced end of the nozzle shank, whose second largest step forms an annular chamber, which serves as a pressure equalization chamber and is preferably connected via a conical surface with the annular duct formed by the third step and this annular duct opens into the mixing chamber via a narrowed part formed by a conical step of the nozzle ring, and the mixing chamber is connected between the stepped end of the nozzle core and the smallest step in the nozzle ring, with the outlet duct.

The invention also relates to a fishtail nozzle provided with heating mixture metering ducts on both longitudinal sides of a cleaning flame or oxygen duct. In this the cross-section of the nozzle shank end is reduced for the formation of a tapering nozzle section and in that on the longitudinal sides of the nozzle core nozzle screens are constructed, in that the metering ducts open into the pressure compensation chamber and in that the mixing chamber forms an annular gap for the emergence of the heating gas mixture.

Having thus described my invention, I now claim

1. A nozzle for welding, heating, cutting, flame cleaning and the like comprising a shank having a substantially central oxygen duct extending axially therethrough to terminate in an outlet opening, a heating gas duct and a heating oxygen duct formed in said shank and extending through said shank substantially parallel thereto, one of said ducts being of a shorter axial length than the other and opening into an annular chamber formed in said nozzle intermediate its ends, a second annular chamber formed in said nozzle at a point spaced from the end of said shorter duct and the other of said ducts opening to said second annular chamber, a first annular passage connecting said first annular chamber and said second annular chamber and a second annular passage connected with said second annular chamber and extending to the end of said nozzle to form an annular outlet disposed around said oxygen outlet opening.

2. The invention as defined in claim 1 and in which said shank has a reduced end portion, a nozzle ring being mounted to said reduced end portion, said first annular chamber, said first annular passage, said second annular chamber and said second annular passage being formed intermediate said reduced end portion of said shank and said nozzle ring.

3. The invention as defined in claim 2 and in which said nozzle ring is formed with several internal steps, a first largest step being provided with means for attaching said nozzle ring to said shank, a second largest step forming said first annular chamber, a third largest step forming said second annular chamber.

4. The invention as defined in claim 2 and in which the inner wall portion of said nozzle ring is conical intermediate said first annular chamber and said second annular chamber to form said first annular passage.

5. The invention as defined in claim 2 and in which the inner wall portion of said nozzle ring is conical intermediate said second annular chamber and the end of said nozzle to form said second annular passage.

6. The invention as defined in claim 1 and including a fourth duct extending completely through said shank and having an outlet radially spaced from said outlet opening of said oxygen duct.

7. The invention as defined in claim 6 and in which said fourth duct is adapted to be connected with a heating gas.

8. The invention as defined in claim 6 and in which the fourth duct has a diameter greater than the diameters of the heating gas duct and the heating oxygen duct.

* * * * *

UNITED STATES PATENT AND TRADEMARK OFFICE

CERTIFICATE OF CORRECTION

PATENT NO. : 4,022,383

DATED : May 10, 1977

INVENTOR(S) : Juan A. Zeley

It is certified that error appears in the above-identified patent and that said Letters Patent are hereby corrected as shown below:

Col. 5, line 28, change "an" to --the--.
line 29, change "the" to --an--.

Signed and Sealed this second Day of August 1977

[SEAL]

*Attest:*

RUTH C. MASON
*Attesting Officer*

C. MARSHALL DANN
*Commissioner of Patents and Trademarks*